US005928590A

United States Patent [19]

Fabbri

[11] Patent Number: 5,928,590

[45] Date of Patent: Jul. 27, 1999

[54] COMPRESSION METHOD FOR POWDER OF GRANULAR MATERIAL

[75] Inventor: Guido Bruno Fabbri, deceased, late of Bondeno, Italy, by Paolo Fabbri Rovatti, Francesco Fabbri, Gabriele Fabbri, legal representatives

[73] Assignee: I.M.A. Industria Macchine Automatiche S.p.A., Ozzano Emilia, Italy

[21] Appl. No.: 08/652,559

[22] PCT Filed: Dec. 9, 1994

[86] PCT No.: PCT/IT94/00208

§ 371 Date: Apr. 23, 1996

§ 102(e) Date: Apr. 23, 1996

[87] PCT Pub. No.: WO95/15847

PCT Pub. Date: Jun. 15, 1995

[30] Foreign Application Priority Data

Dec. 10, 1993 [IT] Italy ..... BO93A0492

[51] Int. Cl.[6] ..... B30B 11/02

[52] U.S. Cl. ..... 264/120; 264/123; 425/345; 425/353

[58] Field of Search ..... 264/120, 123; 425/345, 353

[56] References Cited

U.S. PATENT DOCUMENTS

| | | | |
|---|---|---|---|
| 1,803,801 | 5/1931 | Spengler et al. . | |
| 2,989,781 | 6/1961 | Frank . | |
| 3,677,673 | 7/1972 | Shapiro | 425/345 |
| 3,999,922 | 12/1976 | Shimada | 425/345 |
| 4,108,338 | 8/1978 | Howland et al. | 425/353 |
| 4,943,227 | 7/1990 | Facchini | 425/345 |
| 5,462,427 | 10/1995 | Kramer | 425/345 |

FOREIGN PATENT DOCUMENTS

| | | |
|---|---|---|
| 0 473 458 | 3/1992 | European Pat. Off. . |
| 1 584 370 | 4/1970 | Germany . |
| 2 029 094 | 12/1970 | Germany . |
| 321748 | 12/1929 | United Kingdom . |
| 785017 | 10/1957 | United Kingdom . |

*Primary Examiner*—Mary Lynn F. Theisen
*Attorney, Agent, or Firm*—Nims, Howes, Collison, Hansen & Lackert

[57] ABSTRACT

A method for compressing powder or granular material by a rotary tabletting machine (1), includes an initial step in which an opening (2) is filled with material to be compressed, a compacting step (C), in which a load is gradually applied to the material until a maximum value (F1) is reached, a first releasing step (R1) in which the load is removed, a precompression step (P), in which a second load (F2) is applied to the material, a precompression step (MP), in which the second load (F2) is maintained, and a second releasing step (R2), in which the second load is released, a main compression step (CP), in which a third load (F3), that is not smaller than the previous loads (F1,F2), is applied to the material, and a final ejecting step in which the tablet is discharged from the opening (2).

3 Claims, 4 Drawing Sheets

COMPRESSION METHOD FOR POWDER OF GRANULAR MATERIAL

TECHNICAL FIELD

The present invention relates to the technical field concerning the production of aggregates by compressing powder or granular material.

In particular, the invention refers to a new operative method that defines the sequence of the steps of a compression cycle, usually performed by a rotary tabletting machine that includes opposed pair of punches.

BACKGROUND ART

In the prior art there are known various rotary tabletting machines, designed to produce the tablets from powder material, these machine comprising one turret driven to rotate around its axis.

Generally, the turret has means joined thereto for positioning and batching the material to be compressed, for compressing the powdered material and for ejecting the tablets; see e.g. U.S. Pat. Nos. 2,989,781-A1, 3,677,673-A1, 3,999,922-A1, 4,108,338-A1, 4,943,227-A1.

It is also known that the production of one tablet by a tabletting machine comprises a sequence of steps, that is, a filling step in which a suitable opening is filled with an appropriate quantity of material to be compressed, a volumetric batching of the material in the said opening, optionally a precompression step, and then the subsequent compression of the material, with consequent formation of a tablet having determined thickness. Finally, a step occurs in which the tablet is ejected from the opening.

All the above mentioned steps take place during respective angular sections of a rotation of the turret, and each working cycle can be carried out in a complete round or in a less extended arc.

The pre-compression step has the purpose of reducing the problems resulting from the fact that the tablet, in its interior, keeps embedded small quantities of air that can provoke microfractures, flackings or even explosion of the same tablet during ejection.

A tabletting machine that performs the pre-compression step is known from the European Patent 0204266-B1.

In another method, that has been proposed in a more recent time, a precompression load is kept constant for predetermined time, much longer than the usual precompression and compression times.

A tabletting machine performing a sequence which includes main and auxiliary compression steps is also known from DE 2.029.094. The said compression sequence comprises one or more main compression steps of around 2000 Kg, each of whose can be followed by an auxiliary compression step, provided by guide rails, of 300 to 1200 Kg.

Tablets obtained by applying these auxiliary compression steps are harder, and appear to have a smaller elastic return after compression.

Alternative or complementary methods, like the one that provides addition of binding materials, have been applied in order to reduce the above mentioned problems, but they have not resolved them definitely.

DISCLOSURE OF THE INVENTION

The object of the present invention is to propose a new operative method for compression of powders that permits to reduce, without affecting the throughput performance, the embedment of air inside the material during compression, and therefore, to obtain the tablets with the required hardness and compactness and without defects.

Consequently, the machines that carry out this method may advantageously apply lower compression loads with respect to tabletting machine that carry out other known methods.

The aforementioned object is obtained by means of a method for compression of powder or granular material by a rotary tabletting machine for the production of tablets inside openings, by compression means.

The subject method includes, for each tablet production cycle, the subsequent operative steps in the following order:

- an initial step in which the opening is filled with the material to be compressed;
- a gradual compacting step, having a predetermined length, during which an increasing load is applied to the material, until said load reaches a first pre-established value;
- a first release step, during which the load applied in the compacting step is substantially decreased or removed;
- a precompression step, subsequent to the compacting step, in which a precompression load of a second pre-established value is applied to the material;
- a precompression maintenance step, in which the load applied in the previous step is kept constant at the second value reached in this step;
- a second release step, durng which the load applied in the previous step is substantially decreased or removed;
- a main compression step, in which a further load is applied to the material to be compressed, until a third value, identical or different from the precedent first and second values, is reached, said third value determining the final features of the tablet;
- a final step, in which the said tablet is ejected from the opening.

BRIEF DESCRIPTION OF THE DRAWINGS

The characteristic features of the present invention are pointed out in the following, with reference to the enclosed drawings, in which.

BEST MODE OF CARRYING OUT THE INVENTION

Figures 1, 1A:
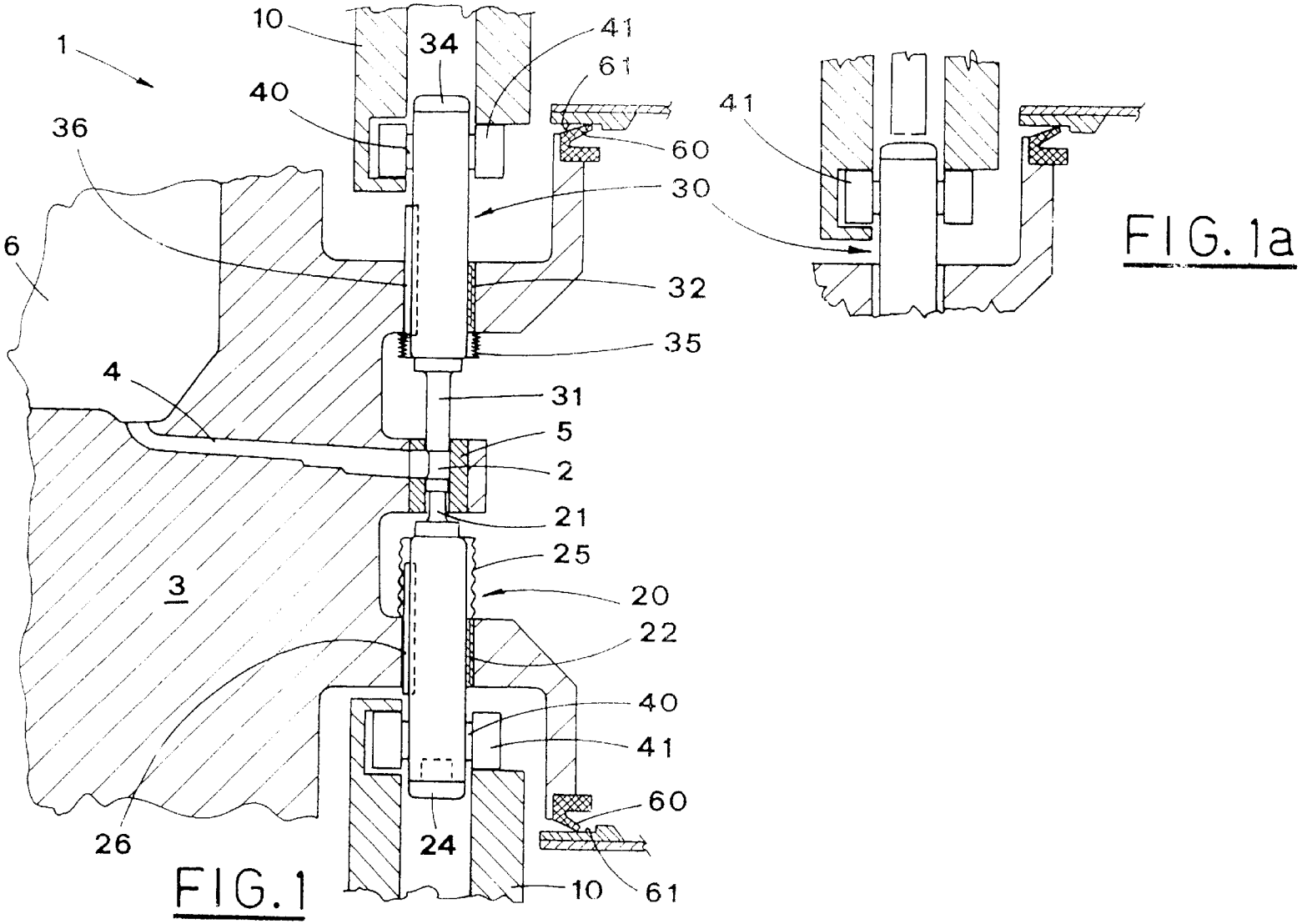
FIG. 1 shows a lateral sectional and schematic view of a portion of a tabletting machine that carries out a first embodiment of the method being the subject of the present invention.
FIG. 1*a* shows a constructive detail of the said tabletting machine in an operative step different from the one of the previous figure.

With reference to FIGS. 1 and 1*a*, reference numeral 1 indicates a rotary tabletting machine for the production of tablets in accordance with a preferred embodiment of the proposed method.

In this machine some improvements are incorporated which are matter of a corresponding patent application filed under the No. BO93A 000493 by the same Applicant.

This machine includes a turret 3, rotatably carried by a supporting frame, not illustrated, and driven to rotate around its own axis by driving means, not illustrated, since they are known.

A ring-like member 5 is rigidly joined to the said turret 3 in lateral intermediate position.

The said ring-like member 5 features a series of openings 2, obtained by means of through holes whose axes are parallel to the axis of the turret 3. The openings are arranged equispaced along the circumference of the ring-like member 5. This circumference and the turret are coaxial.

There are compressing means 20, 30 for each opening 2, formed by two punches, a lower punch and an upper puch respectively, that are guided by relative through holes 22, 32 made in the turret 3, on opposite parts with respect to the opening 2. The punches of each pair and the related opening are coaxial.

Keys 26, 36, rigidly fastened to the punches 20,30 engage corresponding splines made in the through holes 22, 32 are designed to prevent the punches 20, 30 from undesired rotations.

Each one of the punches 20, 30 is equipped, at the end closer to the said opening 2, with operative heads 21, 31, that are counterfacing.

The heads diameter is inferior than the opening 2 one, so that they can be inserted thereinside.

The ends of each of the cited punches 20, 30 opposite in respect to the ones provided with the respective operative heads 21, 31, are covered by outer heads 24, 34, made of material harder than the body of related punch 20, 30, and that can be removed therefrom in case of wearing.

Correspondent pins 40, extend perpendicular from opposite sides of the punches 20, 30, near the outer heads 24, 34 of these latters, and support idling pairs of rollers 41, with each roller arranged opposite with respect to the other one.

Moreover, each punch 20, 30 has, in its part included between the operative heads 21, 31 and the through holes 22, 32 in which the same punches slide, a concertina collapsible tightness sealing 25, 35.

The aforementioned pairs of rollers 41 are located in correspondence with driving means 10, formed by groove cams, integral with the supporting frame of the tabletting machine. The groove cams 10 and the turret 3 are coaxial.

The groove cams 10 are subdivided into six consecutive angular sections $Z_1$, $Z_2$, $Z_3$, $Z_4$, $Z_5$, and $Z_6$, respectively first, second, third, fourth, fifth, and sixth, which form a complete turn through which each opening 2 is brought.

The sections first $Z_1$, second $Z_2$, and fourth $Z_4$ angular sections drives all the rollers 41, while the third $Z_3$ and fifth $Z_5$ angular sections do not engage the rollers 41 related to the upper punches 30, but only those rollers 41 related to the lower punches 20, keeping the latters in the position reached after having left the previous angular section.

In the remaining sixth angular section $Z_6$ (not completely illustrated) making up a round angle, that is next to the fifth angular section $Z_5$ and immediately precedent to the first one $Z_1$, the groove cams 10 drive the rollers 41 during the well known tablet ejecting operation, after which the initial conditions of the compression cycle are restored.

The above mentioned sections from $Z_1$ to fifth $Z_5$ can be partially displaced in directions parallel to the motion of the punches 20, 30 (see FIG. 3), so as to set different initial volumes of the opening 2 as well as different final volumes of the same opening 2, while the compression operation is performed.

In this way it is possible to set the batched quantity of material to be compressed in the opening 2 and the final dimension of the tablet.

Moreover, the position of the exit part of the first section $Z_1$ with respect to the inlet part of the second section $Z_2$ can be changed continuously, that results in the fact that the said second section $Z_2$ is initially engaged by the pairs of rollers 41 in a position $P_2'$ that is as far from the inlet part of the same second angular section, as the second angular section $Z_2$ is displaced.

The period of time during which the second angular section drives the rollers is varied accordingly.

Since the said pairs of rollers 41 are arranged symmetrically at opposed sides of the punches 20, 30 and engage at the same time the groove cams 10, the axial loads acting on the same punches 20, 30 do not cause any tilting moment at any time on the punches but urges only in a direction parallel to the same punches, thus reducing the friction action made by the punches on the through holes 22, 32.

The turret 3 has sliding sealings located close to the housings of the punches 20, 30, and movable along with the said turret 3.

The sealings rims slide on the outer surfaces 61 that belong to the supporting frame of the tabletting machine 1, with the aim of shielding the punches from the outside.

In correspondence with the terminal parts of the third $Z_3$ and fifth $Z_5$ angular sections, the outer heads 24, 34, of the punches 20, 30 goes into engagement with, in the following sequence, a first pair of rollers 50 and a second pair of rollers 51.

The said pairs of rollers are set idling on respective hubs fitted to the supporting frame of the tabletting machine 1.

The combined action of the groove cams 10 on the rollers 41 and of the pairs of rollers 50, 51 on the outer heads 24, 34 causes the axial displacement of the punches 20, 30, thus changing the mutual distance between the operative heads 21, 31 moment by moment.

In the turret 3, there is made a chamber 6, in which the material to be compressed is gathered. The bottom of the chamber 6 is slightly higher than the ring-like member 5.

The chamber 6 is also connected with all the openings 2 by radial channels 4 in such a way that a slant is created between the bottom of the chamber 6 and each opening 2.

The chamber 6 is supplied with material to be compressed by feeding means, not illustrated, since they are known.

Figure 2:
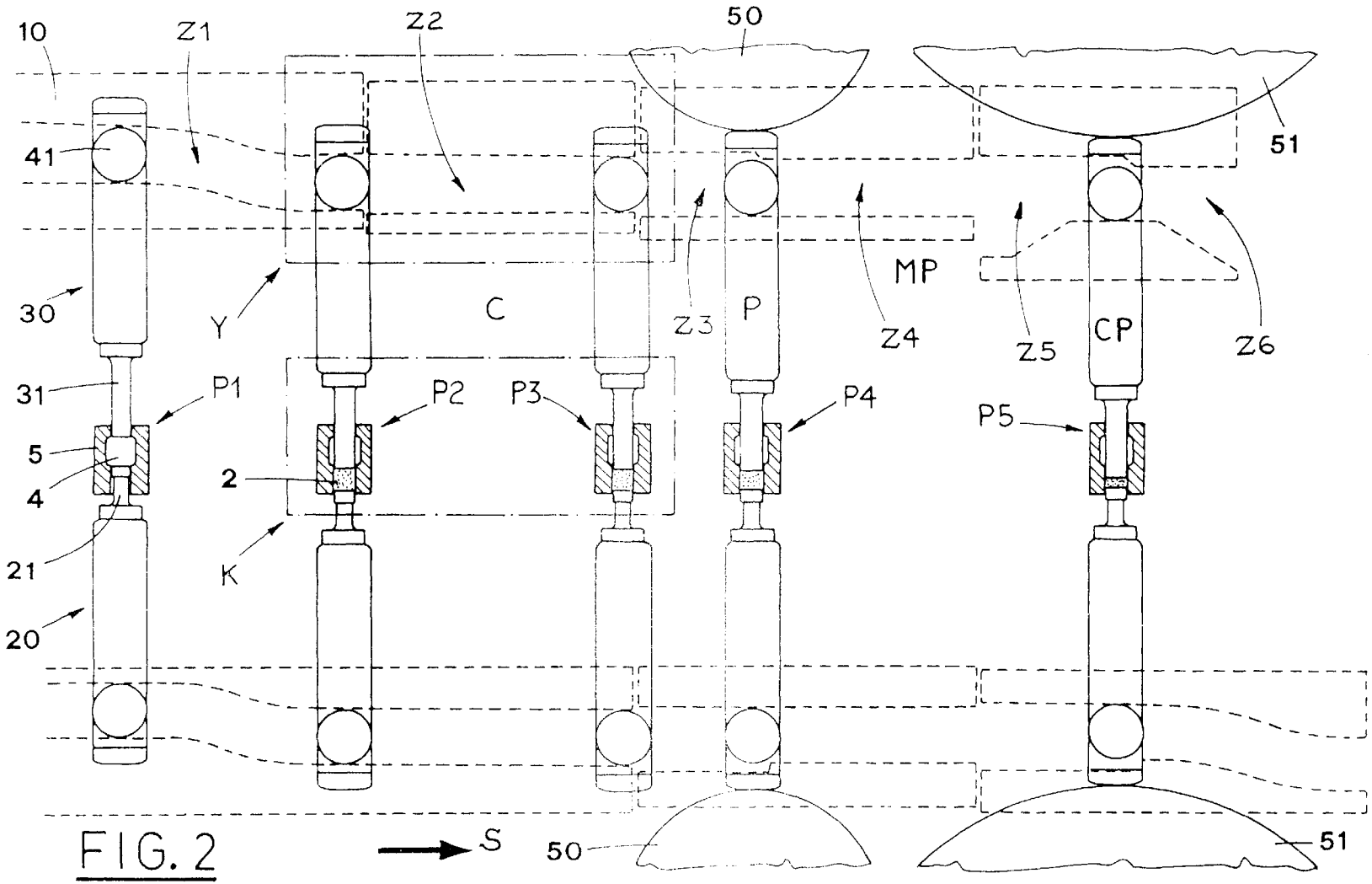
FIG. 2 shows schematically, as an example, the step sequence of an operative cycle in which a tablet is produced according to the method subject of the present invention.
Figure 3:
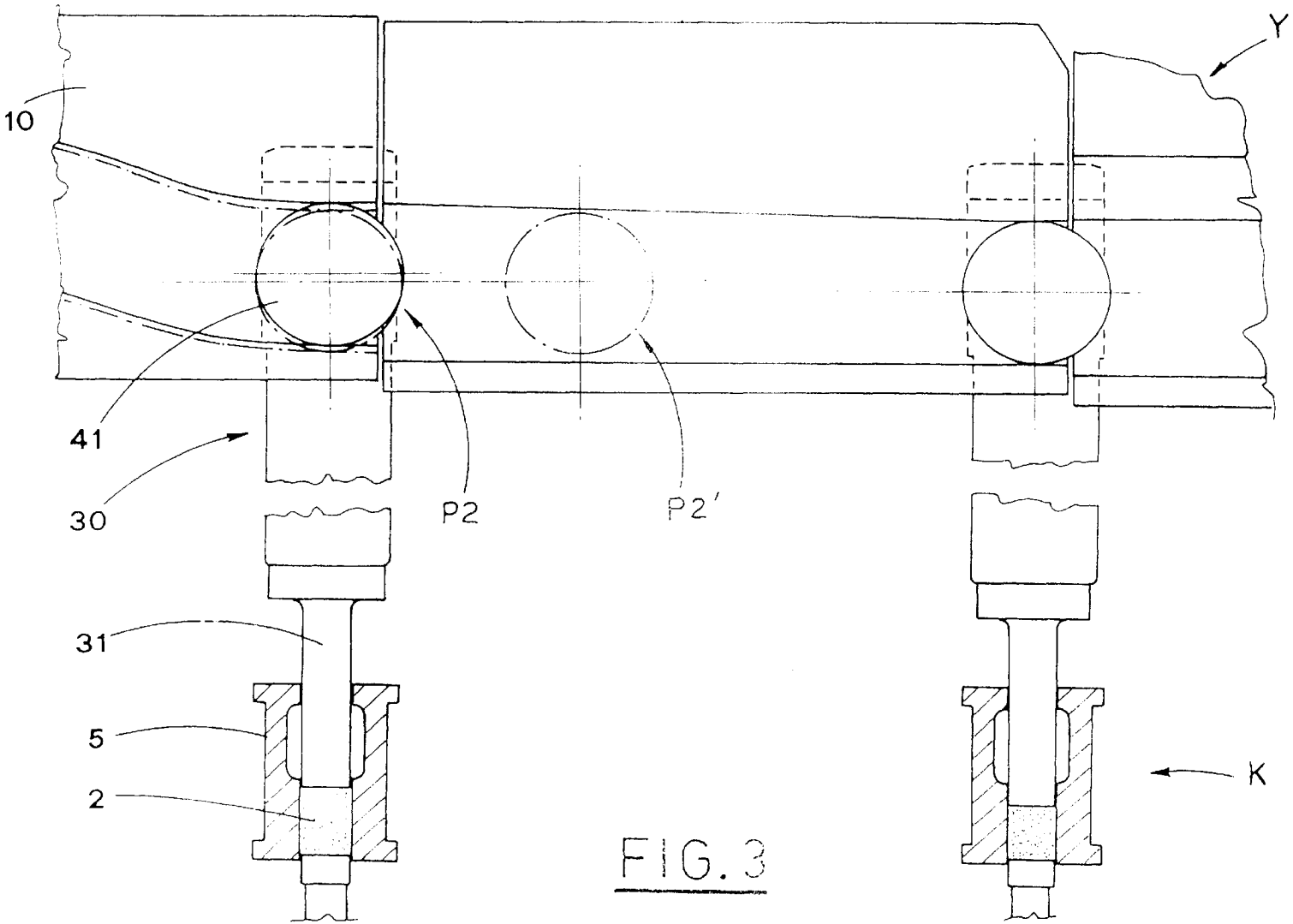
FIG. 3 shows an enlarged view of details Y and K of FIG. 2.
Figure 4:
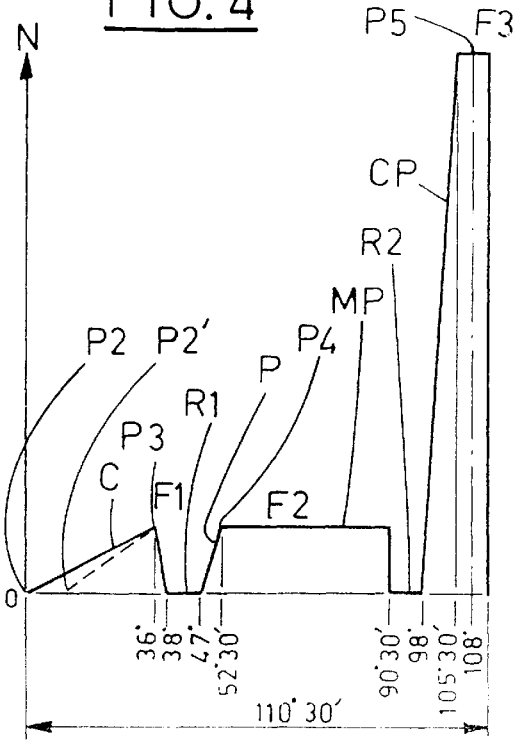
FIG. 4 shows a diagram concerning the loads applied in accordance with an embodiment of the proposed method.

A preferred embodiment of the compression method carried out by the tabletting machine 1 consists of a series of operative steps, illustrated in the following with reference to the FIGS. 2, 3 and 4.

The rotation, in the pre-established direction S, of the turret 3, that brings the series of the punches 20, 30 and the ring-like member 5, that is the related openings 2, through the various sections of the groove cams 10, results in the said punches 20, 30 and related openings 2 running cyclically through angular sections whose respective value can be established conventionally beginning from an angular position in which the mutual position of the operative heads 21, 31 allows to feed, via the feeding channel 4, the opening 2 with the material to be compressed.

The feeding of the cited opening 2 is made easier in every moment by the combined action of gravity and centrifugal force produced by the rotation of the turret 3.

The centrifugal force urges the material that fills the part of the opening 2 delimited by the opposite heads 21, 31, as soon as the position of the operative head 31 permits the channel 4 to communicate with the same opening 2.

In this step, corresponding to a first characteristic position $P_1$ of the operative heads 21, 31, the rollers 41 are driven by the first section $Z_1$ of the cams 10, and the cited heads 21, 31 are translated downwards in synchrony, until the opening 2 and the dose of material contained therein are isolated from the feeding channel 4, and until the same heads are brought to a second characteristic position $P_2'$ that can be conventionally defined as relative to an angular position of 0° (see U.S. Pat. No. 4,943,227 of the Applicant).

The said second position $P_2$ coincides with the beginning of a step C when the material is compacted, in which, e.g. through an arc of 36° the path of the cams 10 in the second angular section $Z_2$, is slightly inclined towards the opening 2 and the head 31 gradually comes closer to the opposite head 21, in such a way that a progressive load is applied to the said material until a first predetermined load value F1 and a first reduction of the volume of the same material is obtained.

The said load F1 is fully applied when the heads 21, 31 are in a third characteristic position $P_3$.

A first release step R1 begins just downstream of the said position $P_3$. In the said release step R1 the pairs of rollers 41 are in the third angular section $Z_3$ of the cams and therefore, the pair of rollers 41 related to the upper punch 30 is disengaged from the cams, while the pair of rollers 41 relative to the lower punch 20 is held in place by the cam 10 and the said punch 20 is kept in the previously reached position.

The angular extension of this step in the example is of 11°. Downstream of the latter position, due to the rotation of the turret 3, a step P is carried out in which the material undergoes a precompression for an angular amplitude of 5°30', until the characteristic position $P_4$ is reached.

In this step the outer heads 24, 34 are stricken by the first pair of rollers 50 and consequently, the heads 21, 31 come nearer to each other until a second predetermined load value F2, e.g. equal with the value F1 obtained in the compacting step C, is obtained.

Immediately downstream of the above mentioned position $P_4$, the pairs of rollers 41 come in the fourth angular section $Z_4$ of the groove cams 10, beginning the activation of a step MP in which the precompression is maintained.

In this step the pairs of rollers 41 are again in engagement with the cams 10, so as to keep, during the whole step MP, the previously reached value of load F2 acting on the material. The angular extension in the example is 38°.

After having passed the above mentioned fourth angular section $Z_4$ the pairs of rollers 41 run along the fifth angular section $Z_5$ of the cams 10.

In this section the pair of rollers 41 relative to the upper punch 30 is again disengaged from the said cams 10, allowing the operative head 31 to activate another step R2 in which the load applied to the material is released, e.g. through an angular extension of 7°30'.

The pair of rollers 41 related to the lower punch 20 are driven by the respective cam 10 and the said punch 20 is kept in the previously reached position.

Subsequently, the second pair of rollers 51 act on the external heads 24, 34 causing the beginning of a main compression step CP and making the operative heads 21, 31 to come closer to each other until they reach a third load value F3, not lower than the value F2 previously reached in the precompression step P.

Activation of this step CP provokes punches 20, 30 and the related openings 2 to move to the characteristic position $P_5$ that coincides with the maximum load position.

The angular extension of the above mentioned step CP is, for example, of 7°30'.

The operative production cycle of one tablet ends with a tablet ejection step, carried out in a known way, in which the said tablet is first carried in a position external to the ring-like member 5, and then it is taken over by known ejecting means, while the punches 20, 30 are brought back to the position $P_1$ for beginning of a new productive cycle.

A compression method as the one described above, with the introduction of the aforementioned compacting C and precompression maintenance MP steps into the operative cycle, permits the material grains to approach reciprocally with a more gradual rate, and therefore their interpenetration is improved.

In this way also the efficiency of air expulsion from the inside of the material is improved, and consequently the tablets are more solid and without imperfections even in the most difficult cases.

The above mentioned improvements are obtained without reducing the rotation speed of the turret 3 and consequently, without affecting negatively the productivity of the tabletting method.

The first $Z_1$ and the second $Z_2$ sections of the groove cams 10 are mutually movable and can be situated in such a way that the pairs of rollers 41 joined to the upper punch 30 go in engagement with the second angular section $Z_2$ in a position $P_2'$ that is as far from the inlet of the same second angular section, as the second angular section $Z_2$ is displaced This allows to optimise the duration of the compacting step C in accordance with the characteristic features of every single material.

Figure 4A:
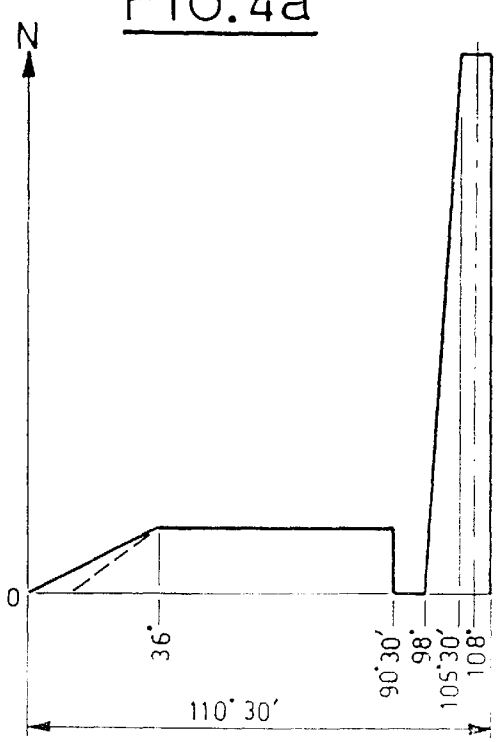
FIGS. 4*a*, 4*b*, and 4*c* show other possible diagrams concerning the loads applied in accordance with other embodiments of the proposed method.

In a second embodiment of the proposed method, whose possible loads diagram is illustrated in FIG. 4*a,* the gradual compacting step is immediately followed by the precompression step P, without the first release step R1 interposed therebetween.

In this way, the load is not removed from the material to be compressed between the cited compacting C and precompression P steps.

The remaining operative steps take place in the order illustrated for the first embodiment of the method.

Figure 4B:
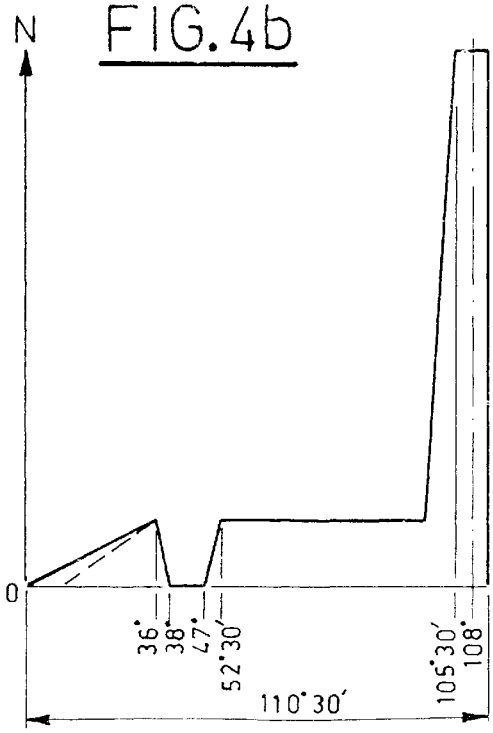

In a third embodiment of the proposed method, the precompression maintenance step MP is followed directly by the main compression step CP, without the second release step R2 interposed therebetween, therefore without that the load is removed from the material. A possible load diagram is illustrated in FIG. 4*b*.

Also in this case the remaining operative steps take place in the order illustrated for the first embodiment of the method.

In a fourth embodiment of the proposed method, the gradual compacting step C is followed directly by the precompression step P, then by the precompression maintenance step MP and, immediately subsequent to this one, by the main compression step CP.

In this way, the first and second release steps R1 and R2, as well as the related removal of the load from the material, are excluded from the operative cycle.

Figure 4C:
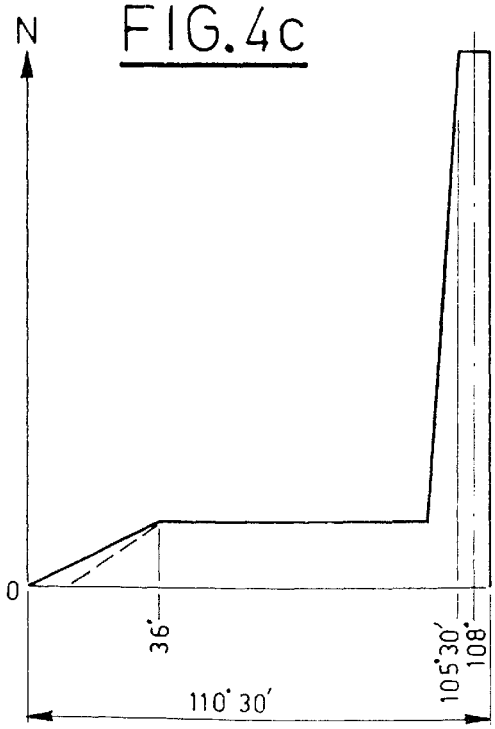

FIG. 4*c* illustrates a possible diagram of the loads concerning this last embodiment.

The remaining operative steps also in this case are the same as in the first embodiment of the method.

Obviously, the invention in question has been described, with reference to the enclosed drawings, as a mere, not limitative example, therefore, it is understood that all the possible changes and variants suggested by either the practice or activation or use of the method are protected by the invention as claimed in the following.

For instance, in the embodiments of the method that include one or both release steps R1 and R2, the loads applied in the precedent phases can be either reduced in their values, or they can be completely discharged.

It is claimed:

1. A method for compression of powder or granular material by a rotary tabletting machine (1) for the production of tablets inside at least one opening (2), by compression means (20, 30), each tablet production cycle comprising the subsequent operative steps, which take place in the following order:

an initial step in which the opening (2) is filled with the material to be compressed;

a gradual compacting step (C), having a predetermined length, during which an increasing load is applied to the material, until said load reaches a first pre-established value (F1);

a precompression step (P), subsequent to the compacting step (C), in which a precompression load of a second pre-established value (F2) is applied to the material;

a precompression maintenance step (MP), in which the load applied in the precompression step (P) is kept constant at the second value (F2);

a main compression step, in which a further load is applied to the material to be compressed, until a third value (F3), identical or different from the first (F1) and second (F2) values, is reached, said third value determining the final features of the tablet;

a final step, in which the tablet is ejected from the opening (2);

the method further including, immediately after said compacting step (C) and immediately before said precompression step, a first release step (R1), of pre-established length during which the value of the load, applied to the material in the gradual compacting step (C), is decreased; and immediately after said maintenance step (MP) and immediately before said main compression step, a second release step (R2), of pre-established length, during which the value of the load, applied to the material in the precompression maintenance step (MP), is decreased.

2. A method for compression of powder or granular material by a rotary tabletting machine (1) for the production of tablets inside at least one opening (2), by compression means (20, 30), each tablet production cycle comprising the subsequent operative steps, which take place in the following order:

an initial step in which the opening (2) is filled with the material to be compressed;

a gradual compacting step (C), having a predetermined length, during which an increasing load is applied to the material, until said load reaches a first pre-established value (F1);

a precompression step (P), subsequent to the compacting step (C), in which a precompression load of a second pre-established value (F2) is applied to the material;

a precompression maintenance step (MP), in which the load applied in the precompression step (P) is kept constant at the second value (F2);

a main compression step, in which a further load is applied to the material to be compressed, until a third value (F3), identical or different from the first (F1) and second (F2) values, is reached, said third value determining the final features of the tablet;

a final step, in which the tablet is ejected from the opening (2);

the method further including, immediately after said maintenance step (MP) and immediately before said main compression step, a release step (R2), of preestablished length, during which the value of the load, applied to the material in the precompression maintenance step (MP), is decreased.

3. A method for compression of powder or granular material by a rotary tabletting machine (1) for the production of tablets inside at least one opening (2), by compression means (20, 30), each tablet production cycle comprising the subsequent operative steps, which take place in the following order:

an initial step in which the opening (2) is filled with the material to be compressed;

a gradual compacting step (C), having a predetermined length, during which an increasing load is applied to the material, until said load reaches a first pre-established value (F1);

a precompression step (P), subsequent to the compacting step (C), in which a precompression load of a second preestablished value (F2) is applied to the material;

a precompression maintenance step (MP), in which the load applied in the precompression step (P) is kept constant at the second value (F2);

a main compression step, in which a further load is applied to the material to be compressed, until a third value (F3), identical or different from the precedent first (F1) and second (F2) values, is reached, said third value determining the final features of the tablet;

a final step, in which the tablet is ejected from the opening (2);

the method further including, immediately after said compacting step (C) and immediately before said precompression step, a release step (R1), of pre-established length during which the value of the load, applied to the material in the gradual compacting step (C), is decreased.

* * * * *